United States Patent [19]

Boster

[11] Patent Number: 4,688,990

[45] Date of Patent: Aug. 25, 1987

[54] PUMP CONSTRUCTION

[75] Inventor: Clark S. Boster, Whittier, Calif.

[73] Assignee: Borg-Warner Corporation, Chicago, Ill.

[21] Appl. No.: 527,913

[22] Filed: Aug. 30, 1983

[51] Int. Cl.[4] ..... F04D 29/08

[52] U.S. Cl. ..... 415/170 A; 415/134; 277/12

[58] Field of Search ..... 415/170 A, 174, 170 R, 415/169, 173 R, 168, 134, 135, 136; 277/12, 236, 200; 285/229

[56] References Cited

U.S. PATENT DOCUMENTS

| | | | |
|---|---|---|---|
| 1,796,325 | 3/1931 | Flanders | 415/134 |
| 2,624,599 | 1/1953 | Eaton | 415/170 A |
| 2,798,743 | 7/1957 | Olesten | 285/229 X |
| 3,043,559 | 7/1962 | Bauer et al. | 415/136 |
| 3,131,941 | 5/1964 | Donley | 415/170 A |
| 3,137,237 | 6/1964 | Zagar et al. | 415/169 |
| 3,313,517 | 4/1967 | Hanschke et al. | 415/134 |
| 3,392,675 | 7/1968 | Taylor | 415/182 |
| 3,671,137 | 6/1972 | Ball | 415/104 |
| 4,212,472 | 7/1980 | Mizuno et al. | 277/12 |
| 4,279,424 | 7/1981 | Zerlauth | 415/173 R |
| 4,289,338 | 9/1981 | Cook | 285/229 |

*Primary Examiner*—Robert E. Garrett
*Assistant Examiner*—John Kwon
*Attorney, Agent, or Firm*—Aubrey L. Burgess

[57] ABSTRACT

A centrifugal pump especially adaptable for pumping radioactive water at elevated temperatures and pressures and having a relatively flexible seal between its case and its cover plate. The seal comprises a plurality of nested, metal, half-toroidal and relatively thin members welded to spaced metal rings which are welded to the case and the cover plate, respectively.

9 Claims, 5 Drawing Figures

PUMP CONSTRUCTION

BACKGROUND OF THE INVENTION

This invention relates to centrifugal pumps and especially to nuclear reactor recirculation pumps which pump radioactive demineralized water at elevated temperatures, as for example, about 530° F. to about 570° F. and elevated pressures, as for example, about 1500 psi to about 2500 psi. The vapors of the pumped liquid may also be toxic. Pumps of this nature comprise a generally cylindrical case with an intake port and a discharge port, and housing a centrifugal impeller. A volute or scroll in the case conducts pumped liquid to the discharge port. The case is capped by a generally cylindrical cover plate, such that a joint is formed therebetween. The cover plate has a central opening for passage of a driven shaft to which the impeller is connected and may house a shaft bearing. An annular gasket or primary seal constructed of metal and asbestos, one form of which is known as "Flexitallic," is positioned between the case and its cover plate to substantially prevent leakage of pumped liquid across the joint and to the atmosphere. Because the vapors of the pumped liquid may be toxic, it is imperative that such leakage be almost, if not completely, eliminated.

In the past, the cover plate has been welded to the case when the primary seal leaks. Failures of the welds have been experienced because of movement, even limited, of the cover plate relative to the case due to operating conditions, such as the effects of pressure and temperature. Failure of the welds have also been experienced because of joint imperfections.

More recently, as a solution to the leakage problem, it has been proposed to weld a one piece, relatively inflexible, cast or machined member to the case and the cover. The member is constructed to bridge the joint between the case and the cover. Here again, this seal can fail because of its lack of flexibility.

SUMMARY OF THE INVENTION

According to this invention, an apparatus through which fluid flows has two parts and a joint between the parts. Sealing means is provided for the joint. The sealing means includes a plurality of nested, relatively thin and flexible sheet-like members having spaced edges. These nested members bridge the joint between the part. One edge of the sealing means is welded to one of these parts, and the other edge is welded to the other of the two parts, thus preventing leakage of fluid outside the apparatus.

In accordance with another aspect of this invention, a seal comprising a plurality of nested and relatively thin, sheet-like metal members are welded to the case and cover plate of a pump of the type before described. The metal members are formed with a semi-toroidal configuration and are joined, by welding, to rings welded directly to the case and cover plate, respectively. Because of the nested construction, limited flexibility is provided between the case and the cover plate, so that failure of a seal from flexing of the parts is reduced.

The seal of this invention is generally used as a secondary seal, the conventional gasket between the case and the cover plate being the primary seal. However, in some less demanding applications, the seal of this invention can be used as the primary seal, and the conventional gasket can be eliminated.

DETAILED DESCRIPTION OF THE PREFERRED EMBODIMENT

Figure 1:
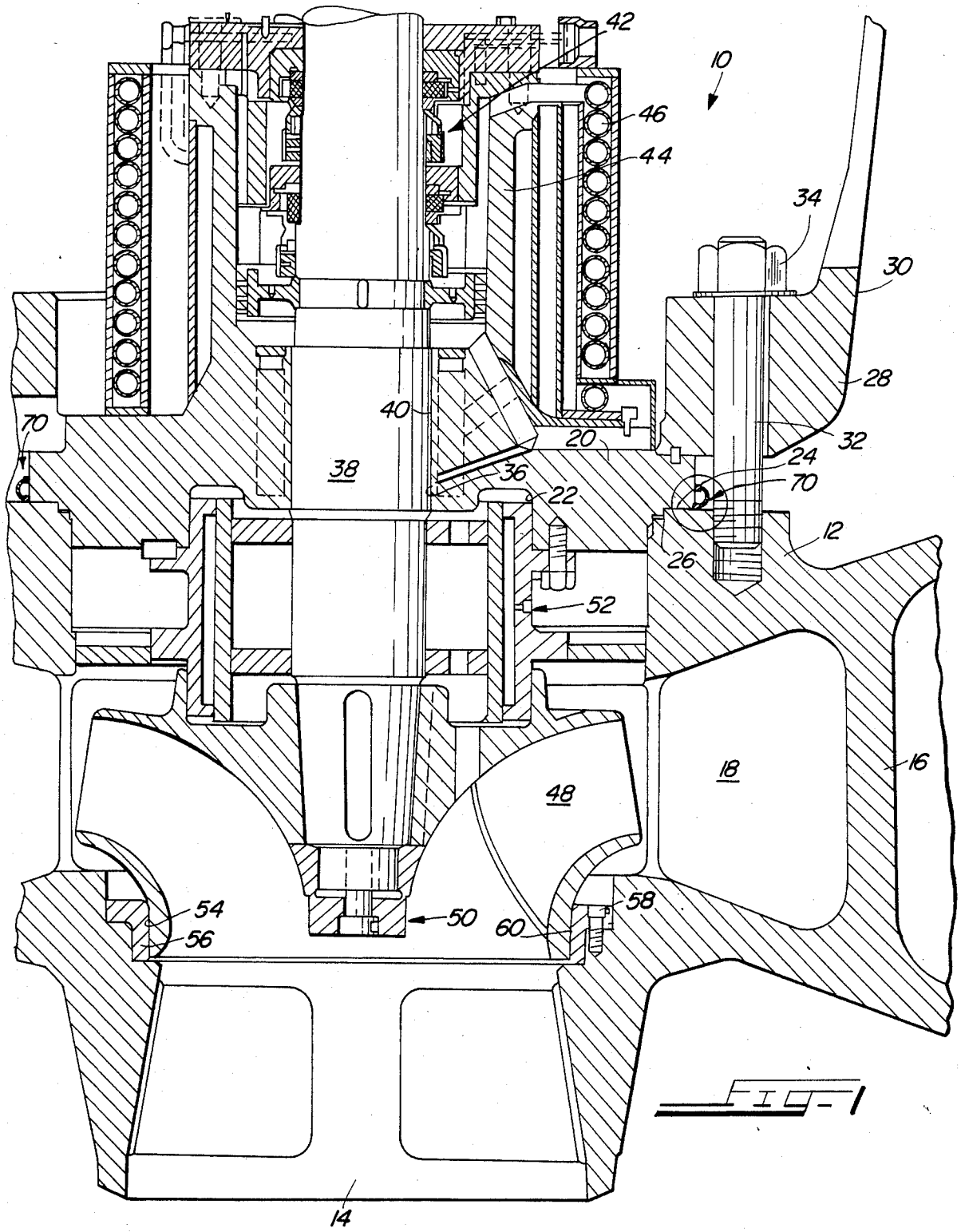
FIG. 1 is a partial cross-sectional illustration of a pump constructed according to this invention.

FIG. 1 illustrates a portion of a typical, vertical shaft, centrifugal pump 10 especially adaptable for recirculating radioactive demineralized water and incorporating the invention herein disclosed. The pump 10 has a case 12, including a suction port 14 and a discharge port 16. As is usual in centrifugal pumps, the case has an integral volute or scroll 18 for conducting the liquid being pumped to the discharge port 16. A top cover plate 20 is fastened to the top of the case 12, and if removed, provides access to the interior 22 of the case for repair and/or replacement of the pump parts.

The cover plate 20 is sealed to the upper wall 24 of the case by an annular gasket 26 and is fastened to the case by a flange 28 of a driver mount 30, studs 32 and nuts 34. The cover plate has a central shaft opening 36 through which a vertical shaft 38 extends from the exterior of the pump into the interior 22 of the case 12. The opposed portions of the shaft 38 and the cover plate 20 provide a labyrinth seal 40 therebetween, as is known in the art. Further sealing means, such as a mechanical seal assembly 42 surround the shaft 38 and, are in turn surrounded by an upwardly extending cylindrical portion 44 of the cover plate 20. A heat exchanger 46 surrounds the portion 44 of the cover plate 22.

The shaft 38 is supported for rotation by means of a vertical thrust bearing (not shown) and is driven by an electric motor (not shown) attached to the driver mount 30. Both the thrust bearing and the motor are located above the pump.

An impeller 48 is mounted at the lower end of the shaft 38 and is connected thereto by a retaining nutlock screw arrangement 50. The impeller 48 pumps liquid from the suction port and discharges the liquid radially into the volute 18 and then from the discharge port 16.

Surrounding the shaft 38 and in the interior 22 of the case 12 is a hydrostatic bearing assembly 52. The hydrostatic bearing assembly 52 supports and centers the shaft 38 when the bearing is supplied with emerging liquid.

The bottom outer portion of the impeller 48 is cylindrical and is grooved to provide a wear ring or clearance ring 54. An opposed, fixed, grooved wear ring 56 is mounted on the case 12 and is secured thereto by one or more screw fasteners 58. The wear rings 54 and 56 are arranged with a close clearance therebetween to provide a labyrinth seal 60 that minimizes leakage of liquid from the discharge side of the impeller back to its suction side when the pump is operational.

The structure thus described is generally conventional and is described in somewhat more detail in Ball U.S. Pat. No. 3,671,137, issued June 20, 1972 and assigned to the assignee of this invention. The disclosure of the Ball patent is incorporated by reference herein.

Figure 2:
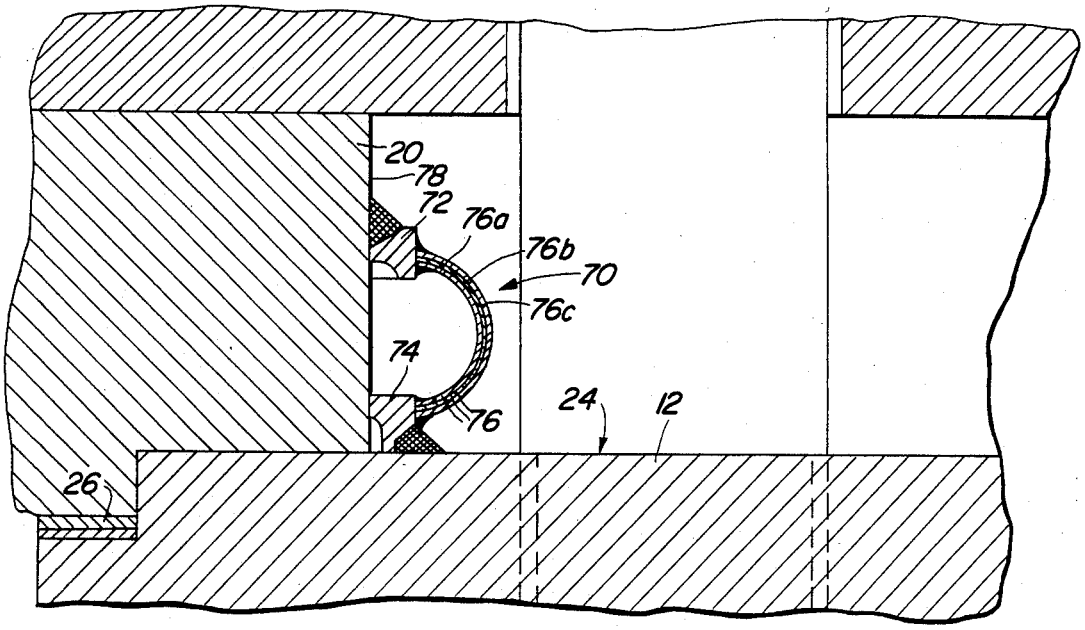
FIG. 2 is an enlarged, partial cross-sectional illustration of that portion of FIG. 1 which is circled and which illustrates the pump case-cover plate seal of this invention.

In the aforesaid patent, the cover plate is described as being removably secured to the upper wall of the case and is removed by removing the nuts from the studs and lifting off the cover. The invention herein comprises providing a seal, generally identified as 70 between the case 12 and the cover plate 20. The seal 70 is indicated in the circled area in FIG. 1 and in an enlarged sectional illustration in FIG. 2.

The seal 70 comprises a pair of spaced metal rings 72 and 74 encircling the cover plate 20 and a plurality of nested half-toroidal and relatively thin, sheet-like metal members 76 (each identified by letter a, b, c, etc.). The members 76 are welded to the rings 72 and 74 and the rings 72 and 74 are welded to the upper wall 24 of the case 12 and the defining wall 78 of the cover plate 20, respectively. This seal 70 is a secondary seal in this embodiment and is in addition to the gasket 26 which is the primary seal. Of course, in some pumps, a seal such as the seal 70 can function as the primary seal. Because of the operational characteristics of the pump 10, some relative movement of the case 12 and the cover plate 20 will occur. The construction of the seal 70 provides a seal which is somewhat flexible and permits some relative movement without loss of the seal.

The metal toroidal sheet-like members 76*a*, 76*b*, etc. are preferably made of rolled 304 stainless steel, each of a thickness of about 0.018 inch to about 0.040 inch. The number of such sheets is determined by the pump requirements, as for example, two such members are used for the lower pressure and temperature pumps while more are used for higher pressure and temperature pumps. The rings 72 and 74 are preferably made of 304 stainless steel and are electron beam welded to the members 76. The subassembly of nested members and rings is then welded to the case and cover.

Figure 5:
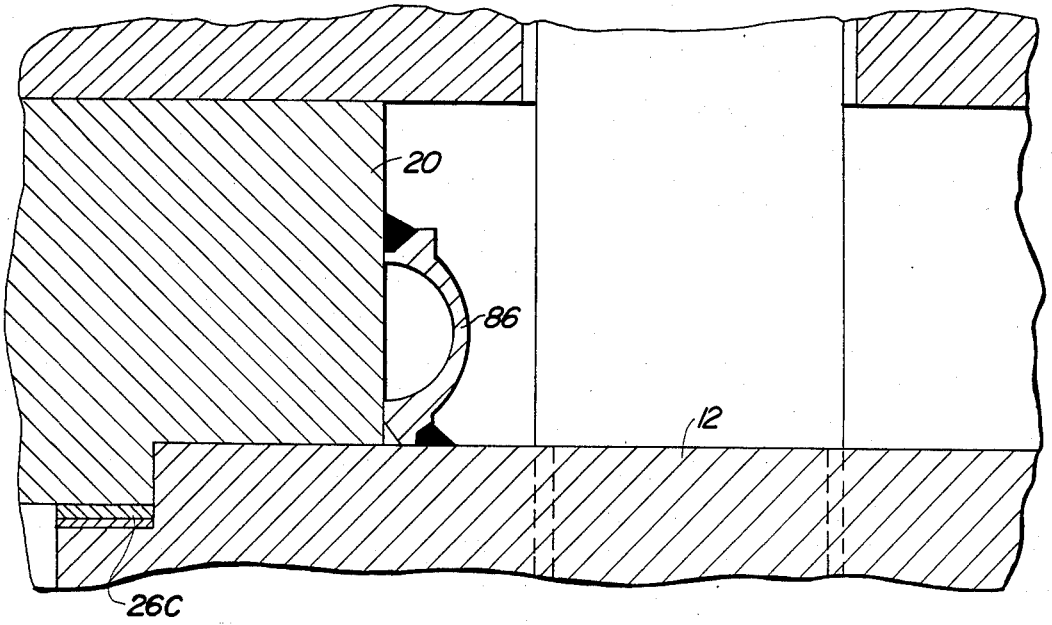
FIG-5 PRIOR ART
FIGS. 3, 4 and 5 are partial cross-sectional illustrations of prior art pump case-cover plate seals referred to in the BACKGROUND portion of this specification and labeled "PRIOR ART".
Figure 3:
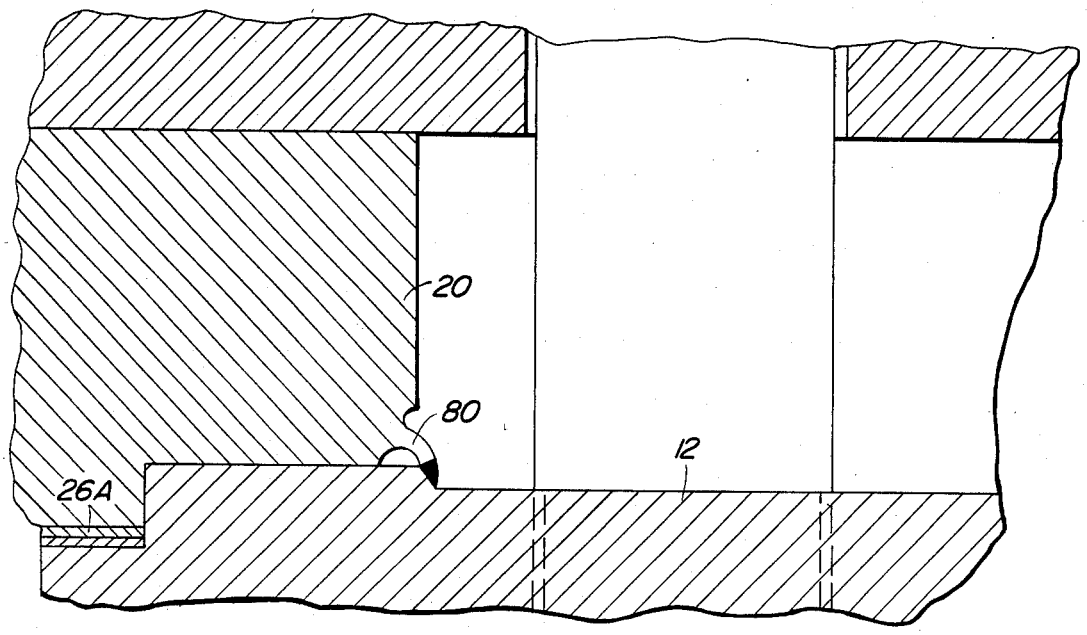
FIG-3 PRIOR ART
Figure 4:
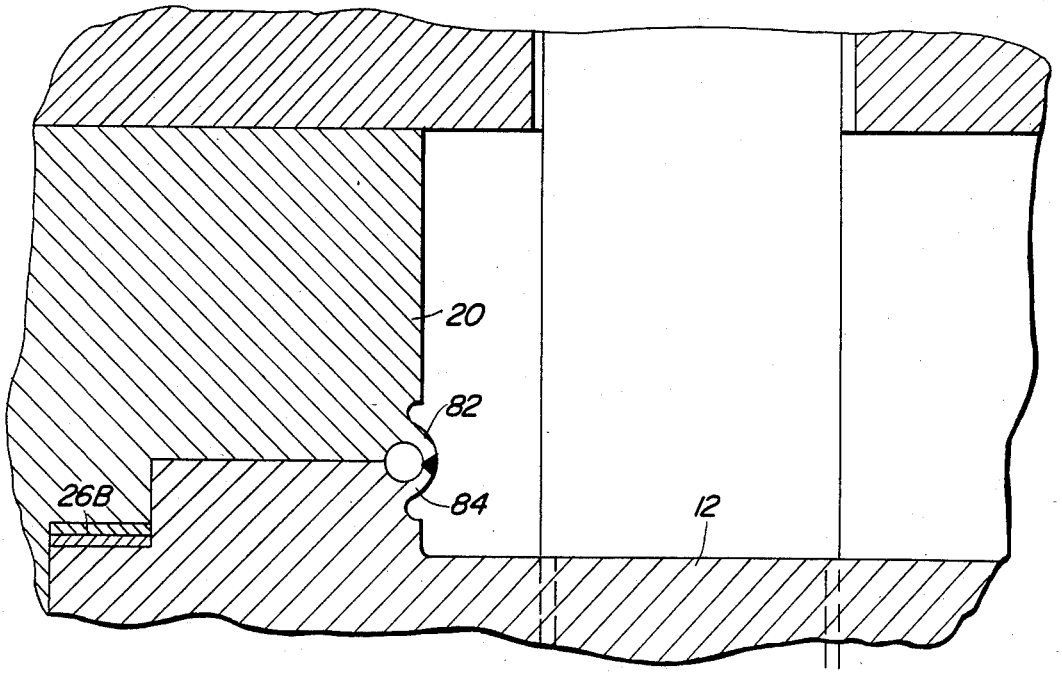
FIG-4 PRIOR ART

In prior art pumps, various seals have been suggested. Three types are illustrated in FIGS. 3, 4 and 5. Each is labeled "PRIOR ART." In FIG. 3, in the event of a failure of the annular gasket primary seal, identified as 26A, positioned between the case 12 and the cover 20, a lip 80 of the cover plate is welded to the case 12. This has not proved entirely satisfactory because the amount of relative movement between the case and the cover plate is severely restricted and failure of such welds has been experienced. In FIG. 4, both the case 12 and the cover plate 20 are provided with lips 82, 84 which are welded together to provide a secondary seal. The primary seal is identified as 26B and is the same as seal 26 of this invention. The same results occur as with the FIG. 3 structure.

In FIG. 5, a solid, one piece metal member 86 of curved cross-sectional configuration is welded at its ends to the case 12 and cover plate 20, respectively, of a pump to provide a secondary seal. The primary seal is identified as 26C and is the same as 26 of this invention. The degree of flexibility of such a seal is less than that of the seal of this invention. The cost of the seal shown in FIG. 5 is higher than that of the seal of this invention because the metal member is machined from a solid shape of metal.

While the invention has been described with reference to one embodiment, the appended claims are intended to cover reasonable equivalents.

I claim:

1. In a pump especially adaptable for pumping relatively high temperature radioactive liquids and which comprises a generally cylindrical pump case and a generally cylindrical pump case cover and in which an annular gasket is interposed in an annular joint between the case and the cover as a primary seal to substantially prevent the leakage of pumped liquid through the joint, the improvement comprising:

a secondary seal constructed of a plurality of nested, relatively thin and flexible sheet-like metal members encircling the case cover, welded to the case and the the cover, and bridging said joint, said secondary seal permitting limited flexing of the joint under pump operating conditions and preventing the leakage of pumped liquid from said joint in the event said gasket fails.

2. In a pump as recited in claim 1, further comprising a first ring welded to one end of said secondary seal members and interposed between said members and said cover, and a second ring welded to the other end of said secondary seal members and interposed between said members and said case, said first and second rings being welded respectively to said cover and said case.

3. In a pump as recited in claim 1 in which said nested secondary seal members are semi-torodial in configuration.

4. In a pump for pumping a liquid and having a generally cylindrical case and a genereally cylindrical cover forming a joint therebetween, the improvement comprising:

a seal constructed of a plurality of nested, relatively thin and flexible sheet-like metal members encircling said case and cover and welded thereto to bridge the joint therebetween, said seal substantially preventing the leakage of pumped liquid through said joint and permitting limited flexing of the joint under pump operating conditions.

5. In a pump as recited in claim 4, further comprising of a first ring welded to one end of said seal members and interposed between said members and said cover, and a second ring welded to the other end of said seal members and interposed between said members and said case, said first and second rings being welded respectively to said cover and said case.

6. In a pump as recited in claim 4 in which said nested seal members are semi-torodial in configuration.

7. Means for sealing a joint between two parts of an apparatus through which fluid flows, said sealing means comprising a plurality of nested, relatively thin and flexible sheet-like members having spaced edges, said nested members bridging said joint between said parts and having one edge welded to one of said parts and another edge welded to the other of said parts for preventing the leakage of fluid outside of said apparatus.

8. Means as recited in claim 7, in which said nested members are metal.

9. Means as recited in claim 8, in which said joint is generally circular and said nested metal members encircle said joint, and further comprising a pair of metal rings, one being interposed between and welded to said one edge and said one part, and the other being interposed between and welded to said another edge and the other of said parts.

* * * * *